US006151785A

United States Patent [19]

Morris

[11] Patent Number: 6,151,785

[45] Date of Patent: Nov. 28, 2000

[54] PEN-SHAPED HAIR CLIPPER

[76] Inventor: Lionel Morris, 53 B Disraeli Road, Forest Gate, London E7 9JU, United Kingdom

[21] Appl. No.: 09/078,630

[22] Filed: May 14, 1998

[51] Int. Cl.[7] ..... B26B 19/14

[52] U.S. Cl. ..... 30/206

[58] Field of Search ..... 30/29.5, 43.6

[56] References Cited

U.S. PATENT DOCUMENTS

| | | | |
|---|---|---|---|
| D. 305,162 | 12/1989 | Mockovak | D28/53 |
| D. 339,212 | 9/1993 | Carleton | D28/53 |
| D. 368,984 | 4/1996 | Nakashima et al. | D28/53 |
| D. 376,670 | 12/1996 | Bellm et al. | D28/53 |
| D. 388,543 | 12/1997 | Eguchi et al. | D28/53 |
| 1,941,583 | 1/1934 | Scruggs . | |
| 3,381,373 | 5/1968 | Brown . | |
| 3,526,959 | 9/1970 | Young . | |
| 3,829,966 | 8/1974 | Owens | 30/43.6 |
| 4,985,999 | 1/1991 | Iwasaki et al. | 30/206 |
| 5,012,576 | 5/1991 | Johannesson | 30/29.5 |
| 5,301,425 | 4/1994 | Ferraro | 30/42 |
| 5,606,799 | 3/1997 | Melton | 30/216 |

*Primary Examiner*—Lee Young
*Assistant Examiner*—Sean Smith

[57] ABSTRACT

A shaving apparatus is provided including a housing having an inboard portion and an outboard portion having a hollow configuration. Also included is a flexible wire mesh having a circular configuration being mounted within an end of the outboard portion of the housing. A drive assembly includes a motor situated within the inboard portion of the housing for rotating upon the actuation thereof. A blade unit includes an elongated rod with a disk-shaped blade fixedly coupled thereto and situated adjacent to the wire mesh. The rod has an inboard end which is coupled to the motor for rotating the blade upon the actuation thereof, thereby cutting hair of a user and depositing clippings within the hollow outboard portion of the housing.

5 Claims, 2 Drawing Sheets

FIG 3
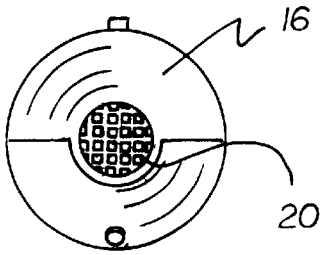
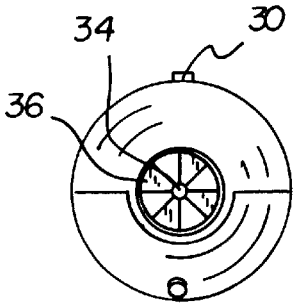
FIG 4
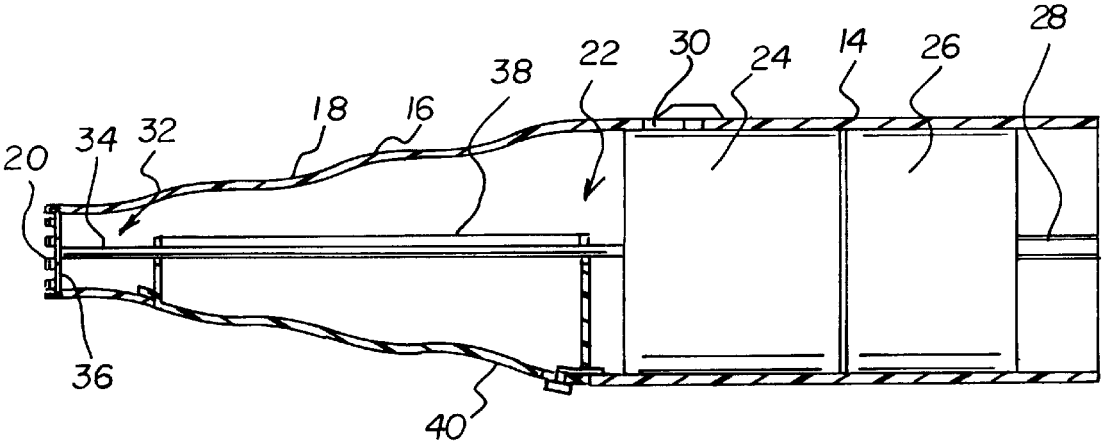
FIG 5

PEN-SHAPED HAIR CLIPPER

BACKGROUND OF THE INVENTION

1. Field of the Invention

The present invention relates to nose and ear hair clippers and more particularly pertains to a new pen-shaped hair clipper for creating designs, initials, words, and/or logos on a head of a user.

2. Description of the Prior Art

The use of nose and ear hair clippers is known in the prior art. More specifically, nose and ear hair clippers heretofore devised and utilized are known to consist basically of familiar, expected and obvious structural configurations, notwithstanding the myriad of designs encompassed by the crowded prior art which have been developed for the fulfillment of countless objectives and requirements.

Known prior art nose and ear hair clippers include U.S. Pat. No. 5,255,437; U.S. Pat. No. 5,012,576; U.S. Pat. No. 4,972,584; U.S. Pat. No. 4,514,903; U.S. Pat. No. 4,521,962; and U.S. Pat. No. Des. 340,783.

In these respects, the pen-shaped hair clipper according to the present invention substantially departs from the conventional concepts and designs of the prior art, and in so doing provides an apparatus primarily developed for the purpose of creating designs, initials, words, and/or logos on a head of a user.

SUMMARY OF THE INVENTION

In view of the foregoing disadvantages inherent in the known types of nose and ear hair clippers now present in the prior art, the present invention provides a new pen-shaped hair clipper construction wherein the same can be utilized for creating designs, initials, words, and/or logos on a head of a user.

The general purpose of the present invention, which will be described subsequently in greater detail, is to provide a new pen-shaped hair clipper apparatus and method which has many of the advantages of the nose and ear hair clippers mentioned heretofore and many novel features that result in a new pen-shaped hair clipper which is not anticipated, rendered obvious, suggested, or even implied by any of the prior art nose and ear hair clippers, either alone or in any combination thereof.

To attain this, the present invention generally comprises a housing having an inboard portion with a cylindrical configuration. As shown in FIGS. 2 & 5, the inboard portion of the housing has a predetermined length and a constant diameter along the length thereof. An outboard portion of the housing has a hollow, generally frustoconical configuration and a length equal to that of the inboard portion. The outboard portion has a plurality of concentric undulations formed therein along the length thereof and an open end. FIGS. 3 & 5 best show a flexible wire mesh having a planar, circular configuration. In use, the wire mesh is mounted within the open end of the outboard portion of the housing. As shown in FIG. 3, the wire mesh defines a matrix of square cut outs. FIG. 5 depicts a drive assembly of the present invention. The drive assembly includes a cylindrical motor mounted within a front extent of the inboard portion of the housing. A rechargeable cylindrical battery is mounted within an intermediate extent of the inboard portion of the housing. A port is connected to the battery and extends therefrom. Ideally, the port extends through a rear extent of the inboard portion of the housing for being coupled to a charger stand for recharging the battery. Mounted on an outer surface of the front extent of the inboard portion of the housing is a toggle switch. The toggle switch is connected between the battery and the motor for selectively actuating the motor. Next provided is a blade unit including an elongated rod of a length equal to that of the outboard portion of the housing. A disk-shaped blade is fixedly coupled to a front end of the rod. As shown in FIG. 3, the rod extends coaxially through the outboard portion of the housing and the blade resides adjacent to the wire mesh. The rod has an inboard end which is coupled to the motor for rotating the blade upon the actuation thereof. By this structure, hair of a user may be cut and deposited within the hollow outboard portion of the housing. For allowing the expelling of clippings deposited within the outboard portion of the housing, a cut out is preferably formed therein, as shown in the Figures. The cut out ideally spans a length of the outboard portion of the housing and encompasses ½ a diameter of the outboard portion. The cut out further has a lid hingably coupled thereto for allowing the selective emptying of the clippings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pen-shaped hair clipper apparatus and method which has many of the advantages of the nose and ear hair clippers mentioned heretofore and many novel features that result in a new pen-shaped hair clipper which is not anticipated, rendered obvious, suggested, or even implied by any of the prior art nose and ear hair clippers, either alone or in any combination thereof.

It is another object of the present invention to provide a new pen-shaped hair clipper which may be easily and efficiently manufactured and marketed.

It is a further object of the present invention to provide a new pen-shaped hair clipper which is of a durable and reliable construction.

An even further object of the present invention is to provide a new pen-shaped hair clipper which is susceptible of a low cost of manufacture with regard to both materials and labor, and which accordingly is then susceptible of low prices of sale to the consuming public, thereby making such pen-shaped hair clipper economically available to the buying public.

Still yet another object of the present invention is to provide a new pen-shaped hair clipper which provides in the apparatuses and methods of the prior art some of the advantages thereof, while simultaneously overcoming some of the disadvantages normally associated therewith.

Still another object of the present invention is to provide a new pen-shaped hair clipper for creating designs, initials, words, and/or logos on a head of a user.

Even still another object of the present invention is to provide a new pen-shaped hair clipper that includes a housing having an inboard portion and an outboard portion having a hollow configuration. Also included is a flexible wire mesh having a circular configuration being mounted within an end of the outboard portion of the housing. A drive assembly includes a motor situated within the inboard portion of the housing for rotating upon the actuation thereof. A blade unit includes an elongated rod with a disk-shaped blade fixedly coupled thereto and situated adjacent to the wire mesh. The rod has an inboard end which is coupled to the motor for rotating the blade upon the actuation thereof, thereby cutting hair of a user and depositing clippings within the hollow outboard portion of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front view of the present invention.

FIG. 4 is a front view of the present invention without the wire mesh.

FIG. 5 is a side cross-sectional view of the present invention taken along a central axis of the housing.

DESCRIPTION OF THE PREFERRED EMBODIMENT

Figure 1:
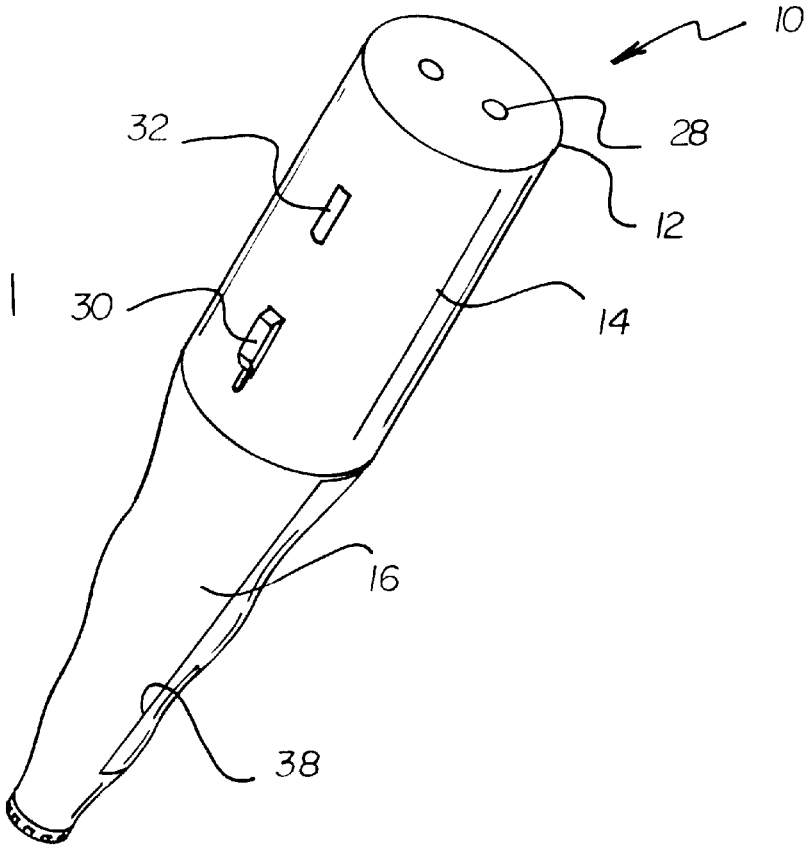
FIG. 1 is a perspective view of a new pen-shaped hair clipper according to the present invention.

With reference now to the drawings, and in particular to FIGS. 1 through 5 thereof, a new pen-shaped hair clipper embodying the principles and concepts of the present invention and generally designated by the reference numeral 10 will be described.

Figure 2:
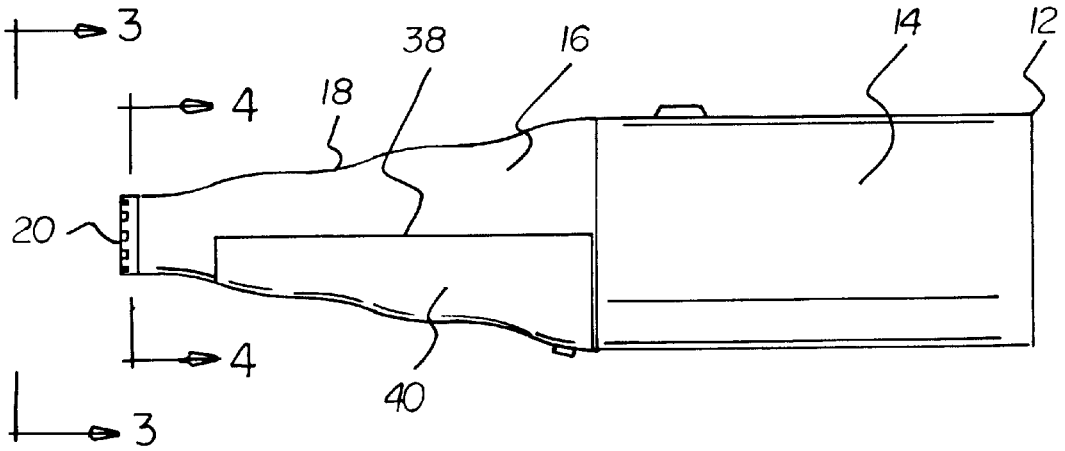
FIG. 2 is a side view of the present invention.

The present invention, designated as numeral 10, includes a housing 12 having an inboard portion 14 with a cylindrical configuration. As shown in FIGS. 2 & 5, the inboard portion of the housing has a predetermined length and a constant diameter along the length thereof. As an option, a plurality of circular pads may be mounted on the inboard portion of the housing for gripping purposes. An outboard portion 16 of the housing has a hollow, generally frustoconical configuration and a length equal to that of the inboard portion. The outboard portion has a plurality of concentric undulations 18 formed therein along the length thereof and an open end. Preferably, at least three undulations are equally spaced along a length of the outboard portion of the housing.

FIGS. 3 & 5 best show a flexible wire mesh 20 having a planar, circular configuration. In use, the wire mesh is mounted within the open end of the outboard portion of the housing. As shown in FIG. 3, the wire mesh defines a matrix of square cut outs.

FIG. 5 depicts a drive assembly 22 of the present invention. The drive assembly includes a cylindrical motor 24 mounted within a front extent of the inboard portion of the housing. A rechargeable cylindrical battery 26 is mounted within an intermediate extent of the inboard portion of the housing. A dual port 28 is connected to the battery and extends therefrom. Ideally, the dual port extends through a rear extent of the inboard portion of the housing for being coupled to a charger stand for recharging the battery. The charger stand preferably has a recess formed therein for releasably receiving the inboard portion of the housing in a vertical orientation.

Mounted on an outer surface of the front extent of the inboard portion of the housing is a toggle switch 30. The toggle switch is connected between the battery and the motor for selectively actuating the motor. In the preferred embodiment, a light is mounted on the housing and actuates whenever the motor is actuated or the battery is recharging.

Next provided is a blade unit 32 including an elongated rod 34 of a length equal to that of the outboard portion of the housing. A disk-shaped blade 36 is fixedly coupled to a front end of the rod. FIG. 4 shows the blade to have a plurality of generally triangular-shaped fins for cutting purposes. It should be understood that the blade may be constructed with any size per the desires of the user. In use, the specific nature of the wire mesh and blade render the present invention suitable for creating designs, initials, words, and/or logos on a head of a user.

As shown in FIG. 3, the rod of the blade unit extends coaxially through the outboard portion of the housing and the blade resides adjacent to the wire mesh. The rod has an inboard end which is coupled to the motor for rotating the blade upon the actuation thereof. By this structure, hair of a user may be cut and deposited within the hollow outboard portion of the housing.

For allowing the expelling of clippings deposited within the outboard portion of the housing, a cut out 38 is preferably formed therein, as shown in the Figures. The cut out ideally spans a length of the outboard portion of the housing and encompasses ½ a diameter of the outboard portion. The cut out further has a lid 40 hingably thereto along an elongated side edge thereof for allowing the selective emptying of the clippings. The lid has a size and shape for completely covering the cut out and further defining the aforementioned undulations. As shown in the Figures, the lid is further equipped with a locking mechanism which may include a pair of magnetic or the like. As an option, an additional indicator light may be included to alert a user when the outboard portion is full of clippings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A shaving apparatus comprising, in combination:

a housing including an inboard portion having a cylindrical configuration with a predetermined length and a constant diameter along the length thereof and an outboard portion having a hollow interior and a generally frustoconical configuration, a length of the outboard portion being substantially equal to the length of the inboard portion, the outboard portion having a plurality of concentric undulations formed therein along the length thereof for enhancing a finger grip of a user on the outboard portion, the outboard portion having an open end at a location opposite of the inboard portion, the open end of the outboard portion being substantially planar, the inboard portion having a first diameter and the open end of the outboard portion having a second diameter, the first diameter of the inboard portion being approximately three times the second diameter of the open end of the outboard portion, a perimeter wall of the outboard portion extending substantially straight from the open end to the inboard portion for providing an exterior gripping surface on the outboard portion that continuously varies from the open end to the inboard portion;

a flexible wire mesh having a circular configuration being mounted in the open end of the outboard portion of the housing, the wire mesh defining a matrix of square cut outs;

a drive assembly including a cylindrical motor mounted within a front extent of the inboard portion of the housing, a rechargeable cylindrical battery mounted within an intermediate extent of the inboard portion of the housing, a port connected to the battery and extending therefrom through a rear extent of the inboard portion of the housing, and a toggle switch mounted on an outer surface of the front extent of the inboard portion of the housing and connected between the battery and the motor for selectively actuating the motor; and a blade unit including an elongated rod of a length substantially equal to that of the outboard portion of the housing and a disk-shaped blade fixedly coupled to a front end of the rod such that the same extends coaxially through the outboard portion of the housing and the blade resides adjacent to the wire mesh, the rod having an inboard end which is coupled to the motor for rotating the blade upon the actuation thereof, thereby cutting hair of a user and catching hair clippings in the hollow outboard portion of the housing;

said outboard portion of the housing having a cut out formed therein, the cut out extending in the length direction of the outboard portion of the housing and encompassing ½ a diameter of the outboard portion, the cut out further having a lid hingably coupled thereto for allowing the selective emptying of the clippings from the interior of the outboard portion without removal of the blade unit or the wire mesh from the outboard portion of the housing.

2. A shaving apparatus comprising:

a housing including an inboard portion and an outboard portion having a hollow configuration, the inboard portion having a cylindrical configuration and the outboard portion having a generally frustoconical configuration, the outboard portion having a plurality of concentric undulations formed in an exterior surface of the outboard portion along the length thereof for enhancing finger grippability of the outboard portion the outboard portion having an open end at a location opposite of the inboard portion, the inboard portion having a first diameter and the open end of the outboard portion having a second diameter, the first diameter of the inboard portion being approximately three times the second diameter of the open end of the outboard portion;

a flexible wire mesh having a circular configuration being mounted within the open end of the outboard portion of the housing;

a drive assembly including a motor situated within the inboard portion of the housing for rotating upon the actuation thereof; and a blade unit including an elongated rod with a disk-shaped blade fixedly coupled thereto and situated adjacent to the wire mesh, the rod having an inboard end which is coupled to the motor for rotating the blade upon the actuation thereof, thereby cutting hair of a user and depositing clippings within the hollow outboard portion of the housing;

wherein the outboard portion of the housing has a cut out formed therein with a lid hingably coupled thereto for allowing the selective emptying of the clippings from an interior of tile outboard portion without removal of the blade unit or the wire mesh from the outboard portion of the housing.

3. A shaving apparatus as set forth in claim 2 wherein the drive assembly includes a battery mounted within the inboard portion of the housing.

4. A shaving apparatus as set forth in claim 1 wherein the cut out extends in the length direction of the outboard portion of the housing and encompasses ½ a diameter of said outboard portion.

5. A shaving apparatus as set forth in claim 2 wherein the wire mesh has a planar circular configuration.

* * * * *